United States Patent [19]

Siebert

[11] Patent Number: 4,754,599

[45] Date of Patent: Jul. 5, 1988

[54] YARN TWISTING APPARATUS

[75] Inventor: Georg Siebert, Huckeswagen, Fed. Rep. of Germany

[73] Assignee: Artec Design GmbH, Remscheid, Fed. Rep. of Germany

[21] Appl. No.: 35,372

[22] Filed: Apr. 7, 1987

[30] Foreign Application Priority Data

Apr. 11, 1986 [DE] Fed. Rep. of Germany ..... 3612321
Oct. 18, 1986 [DE] Fed. Rep. of Germany ..... 3635460

[51] Int. Cl.[4] ..... D01H 7/86

[52] U.S. Cl. ..... 57/58.52; 57/58.49; 57/58.83; 57/58.84; 57/58.86

[58] Field of Search ..... 57/58.3, 58.32, 58.36, 57/58.38, 58.49–58.57, 58.83–58.86

[56] References Cited

U.S. PATENT DOCUMENTS

| | | | |
|---|---|---|---|
| 2,586,038 | 2/1952 | Heffelfinger et al. | 57/58.86 X |
| 2,586,123 | 2/1952 | Truitt | 57/58.86 X |
| 2,728,185 | 12/1955 | Vibber | 57/58.83 X |
| 2,732,680 | 1/1956 | Vibber | 57/58.3 |
| 2,871,648 | 2/1959 | Vibber | 57/58.36 |
| 3,172,247 | 3/1965 | Chapuis et al. | 57/58.52 |
| 3,238,711 | 3/1966 | Lundgren | 57/58.52 |
| 3,295,304 | 1/1967 | Vibber | 57/58.3 |
| 3,499,277 | 3/1970 | Vibber | 57/58.52 X |
| 3,846,965 | 11/1974 | Matsumura et al. | 57/58.52 |
| 4,391,087 | 7/1983 | Greive et al. | 57/58.52 |

*Primary Examiner*—John Petrakes
*Attorney, Agent, or Firm*—Bell, Seltzer, Park & Gibson

[57] ABSTRACT

A yarn twisting apparatus is disclosed for twisting a plurality of yarn strands into a composite yarn, and which comprises a central twisting spindle and yarn guide means for ballooning the yarn about the package as it is withdrawn therefrom. A common drive system is provided for rotating the ballooning means and for advancing the yarn, and a yarn accumulator is provided which is controlled by a sensor such that the drive means is operated only when the amount of yarn on the accumulator is less than a predetermined amount.

17 Claims, 3 Drawing Sheets

YARN TWISTING APPARATUS

FIELD OF THE INVENTION

The present invention relates generally to a yarn twisting apparatus for twisting a yarn strand, and more particularly, the invention relates to a yarn twisting apparatus having a driven twisting spindle and a yarn feeding system positioned in the yarn path of travel and which is driven at a speed coordinated to the speed of the spindle. In such apparatus, it is conventional for two yarn strands to be delivered from separate packages on a package carrier, then combined and twisted together to form a composite yarn.

BACKGROUND OF THE INVENTION

Yarn twisting apparatus are known which operate by the single twisting method, and wherein the package carrier and the feed yarn packages are rotated about the twisting axis. Apparatus are also known which operate by the double or "two for one" twisting method, in which the package carrier is floatingly supported on the rotating twisting spindle, and held against rotation by external forces.

Yarn twisting apparatus operating by the double twisting method are particularly suitable for the described use, since the feed yarn package carrier does not rotate, thus permitting the spindle to reach relatively high speeds, even when the mass of the feed yarn packages is not balanced on the package carrier. As a result, two differently filled yarn feed packages may be employed, and similarly, only a few of the several package supports on the carrier may be employed.

A special advantage of the double twisting devices resides in the fact that the apparatus may be arranged with its axis extending obliquely or horizontally, and it is preferred that a weight be used for holding the package carrier against free rotation, with the weight being positioned to be offset from the rotational axis of the spindle.

To impart a defined twist to a yarn with the above described twisting apparatus, it is necessary that its yarn delivery speed and the rotational speed of the twisting spindle be at a defined ratio, which determines the degree of twist imparted to the yarn. The speed of the advancing yarn and the rotational speed of the spindle therefore need to have a constant value, or at least a predetermined value, with respect to each other. For example, the yarn advancing speed and the spindle speed may be interconnected by mechanical means, or by an electrical linkage. Also, the yarn twisting apparatus may be used to produce yarns with special color effects from a plurality of differently colored yarns, and which may be further processed by hand, for example, by a hand knitting operation, or the yarn may be wound to balls, preferably also by hand.

In the embodiments which are adapted for use by home workers, it will be understood that the output requirements greatly fluctuate in time, as a result for example of the working speed of the knitter, or by the technical conditions of the knitting apparatus. Also, present twisting apparatus of the described types are unable to readily permit varying color effects in the knit product, and in the past, color effects could be achieved only by employing balls of differently dyed yarns, and wherein the yarn of each ball was of the same color over its entire length.

It is accordingly an object of the present invention to provide a yarn twisting apparatus of the described type, which renders it possible to easily change the coloring of the yarn by exchanging the yarn feed packages, and to make the thus produced twisted yarn directly available for further processing.

It is also an object of the present invention to provide a yarn twisting apparatus of the described type, wherein the produced yarn is supplied in accordance with the user requirements, which may fluctuate in time.

SUMMARY OF THE INVENTION

The above and other objects and advantages of the present invention are achieved in the embodiments illustrated herein, by the provision of a yarn twisting apparatus which comprises a central spindle mounted for rotation about a central axis, and a yarn guide which is mounted at a location which is in general alignment with the central axis. A yarn package carrier is mounted adjacent the spindle, and the apparatus also includes yarn accumulation means. Further, drive means is provided for rotating the spindle about the central axis, and for advancing a yarn from a package mounted on the package carrier to the yarn guide and then to the yarn accumulation means at a speed coordinated with the rotational speed of the spindle, and while ballooning an advancing yarn about the central axis as it advances between the package and the yarn guide. Sensor means is also provided for monitoring the amount of yarn received on the yarn accumulation means and for operating the drive means so as to rotate the spindle and deliver twisted yarn to the accumulation means, whenever the amount of yarn on the accumulation means is below a predetermined minimum amount.

In a double twisting apparatus, the central spindle has a coaxial yarn duct therein and which includes an inlet end on one side of the yarn carrier, and an outlet opening on the other side of the carrier. An initial yarn guide means is mounted on the carrier for guiding a yarn withdrawn from a package mounted on the carrier into the inlet opening and so that it exits from the outlet opening. Also, a ballooning yarn guide means is provided which includes a radial guide arm fixedly mounted to the spindle, and which functions to balloon the yarn in the manner described above.

With the present invention, a sufficient quantity of the produced twisted yarn is constantly available for further processing, without risk of an overfeed of the yarn and also without risk of an unacceptable or undue yarn tension.

Where two motors having an electrical connection, or one motor with a mechanical connection, are provided for the drive of the spindle and the drive of the yarn feeding system, the technical complexity connected therewith can be unsuitable for certain applications of the twisting apparatus. Consequently, in accordance with a specific embodiment of the invention, the drive means comprises a single drive member which provides a fixed, preferably selective twist ratio of the yarn advance speed to the imparted twist (turns per meter). To this end, the twisting spindle may be a component part of the yarn feeding system.

In accordance with the present invention, the yarn accumulator may be downstream of the yarn feeding system, or it may be a part thereof. Specifically, the yarn feeding system may be formed by an extension of the spindle, with a pressure roll which is resiliently pressed against the surface of the spindle extension to define a nip therebetween and through which the yarn is adapted to be passed. Where the twisting apparatus is designed and constructed as a double twisting spindle, the extension of the spindle may be positioned at the end of the spindle opposite from the package carrier. To change the twist ratio, it is provided that the spindle extension may be a selected one of a series of removeably mounted sleeves of different outer diameters. Thus sleeves of different diameters may be selectively mounted on the spindle end and be interconnected so as to prevent relative rotation. To this end, a stop may be provided which limits the distance the sleeve may be slipped onto the spindle end, with both the adjacent end of the sleeve and the stop including mating notches, which fit into each other and form a locking interconnection.

In still another embodiment, the spindle includes an end bore, and several exchangable feed extensions having different diameters are provided, with the extensions including a shaft which is adapted to fit into the end bore of the spindle so as to be positively connected to the same.

The yarn accumulating means of the present invention preferably includes a control by which the amount of the accumulated yarn may be determined, and which operates a switch as a function of this amount. Such yarn accumulators are known per se in the art.

In one embodiment, the yarn accumulation means is in the form of a stationary body of rotation, upon which the ballooning or revolving yarn is wound by the yarn guide means. Such a yarn accumulator is used primarily when a double twist is to be applied, and it is arranged coaxially along the central axis and on the same side of the spindle as is the yarn inlet end of the spindle duct. As a result, the yarn is wound on the body of rotation by its ballooning motion. Further, a pivotal arm may be positioned on the surface of the body of rotation, and such that when the arm is overwound with the applied yarn, the arm is deflected to effect a switching of the drive means.

In selecting the design of the yarn accumulation means, it should be recognized that the accumulation means needs to be rigidly constructed for home work applications, it must accumulate a relatively large quantity of yarn, and in addition, it must impart only a small unwinding tension, and small fluctuations of the yarn tension.

In another embodiment of the present invention, the yarn accumulation means comprises two substantially parallel rods, about which the yarn is looped. The rods are mounted for relatively movement toward and away from each other and are preferably biased to move away from each other by an external force, such as gravity or a spring. The rods are thus adapted to move toward each other by the force of the yarn tension. When the distance between the rods is reduced, the drive means for the spindle and feed of the yarn is started, and when the distance is increased beyond a given distance, the drive means is disconnected. As will be apparent, the amount of yarn on the accumulation means is determined by the separation distance of the rods. Preferably, one of the rods is stationary and the other rod pivots about a bearing, with the biasing force being operative on the pivotal yarn guide in the direction tending to move it away from the stationary rod, and the pivotal rod includes a contact for engaging a micro switch for starting and stopping the drive means.

In an embodiment of the present invention which is particularly adapted for double twisting spindles, the yarn guide means includes a guide arm fixedly mounted to the spindle which is in the form of a tube and such that the yarn is positioned on a stationary body of rotation connected to the machine frame. The yarn is then withdrawn from the end of the body of rotation which faces the spindle, and then passed through a central bore in the body of rotation. In this case, the body of rotation serves both as the yarn accumulation means as well as a part of the yarn feeding system. Preferably, the body of rotation has the shape of a cylinder, however it may alternatively have a generally hyperbolic configuration so as to facilitate the yarn withdrawal. The yarn is deposited adjacent the larger end of the body of rotation by the outlet of the tubular guide arm at a defined diametrical area adjacent the larger end, and the larger end may if desired include a boundary lip.

In the last mentioned embodiment, the sensor means may be accommodated in a longitudinally extending slot in the surface of the body of rotation. When the body of rotation is empty, a contact arm projects from the slot, and it is pushed into the slot by the yarn windings. When pushed in the slot, the arm actuates a micro switch which is interposed in the motor circuit and disconnects the drive means. By changing bodies of rotation having different operative diameters, the ratio of the yarn advance speed to the imparted twist may be changed. A special advantage of this yarn accumulation means is that it also serves as a part of the yarn feeding system, which is started and stopped along with the starting and stopping of the spindle.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
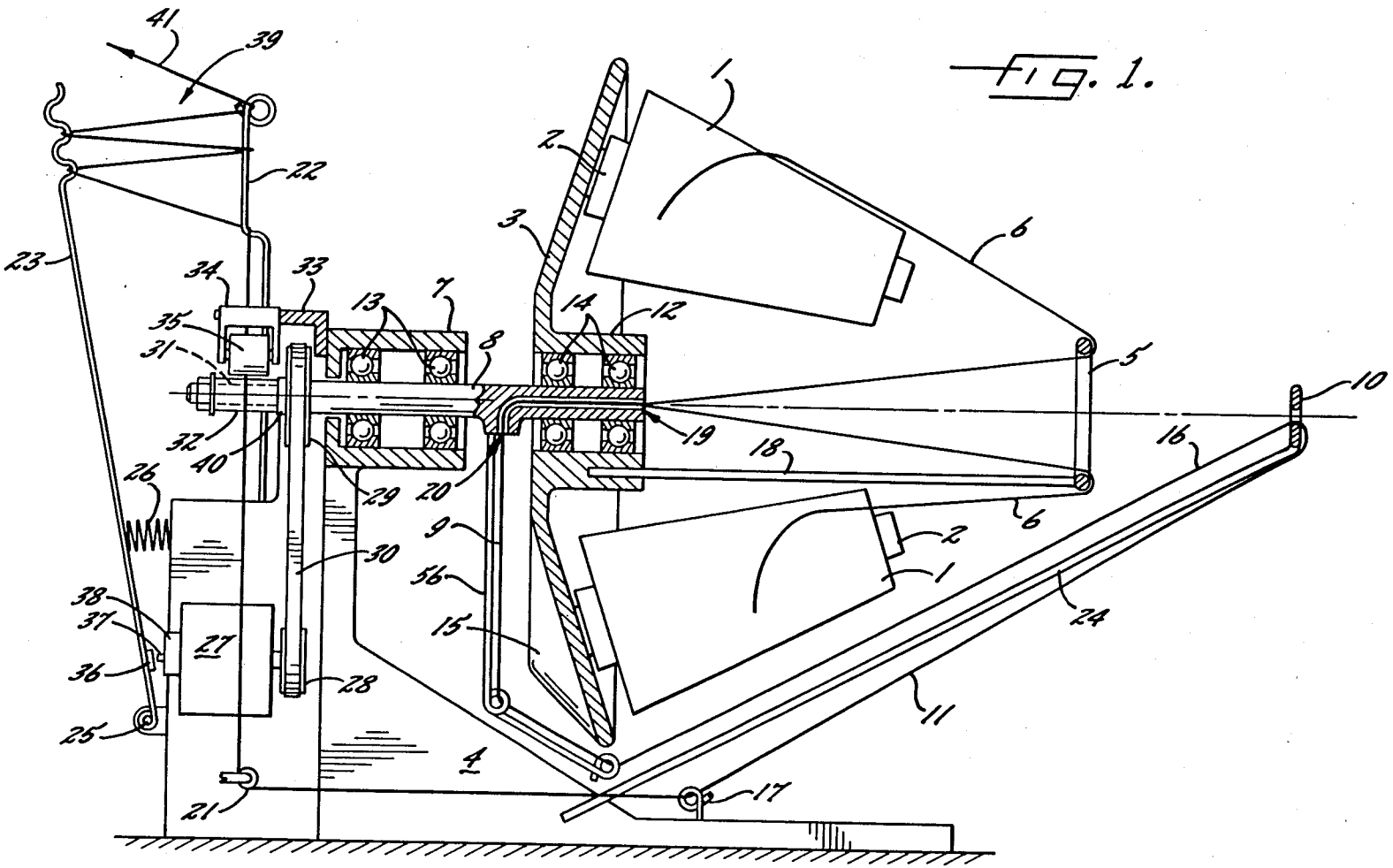
FIG. 1 is a partly sectioned side elevation view of a yarn twisting apparatus embodying the features of the present invention.

Referring more particularly to the drawings, FIG. 1 illustrates a first embodiment of a yarn twisting apparatus according to the present invention. The illustrated apparatus comprises a central spindle 8 which is mounted for rotation about a central axis by means of bearings 13 which are accommodated in a bearing block 7 attached to the machine frame 4. On its right or outer end as seen in FIG. 1, the spindle 8 mounts a yarn package carrier 3 which holds the yarn supply packages 1. More particularly, the package carrier 3 is supported for rotation with respect to the spindle by means of a hub 12 and bearings 14, and the carrier includes a weight 15 which precludes the package carrier 3 from free rotation when the central axis of the spindle 8 extends substantially horizontally. The carrier 3 also mounts a plurality of package supports 2 which in turn mount the packages 1 in a circular arrangement about the central axis of the spindle 8.

The yarns 6 which are unwound from the supply packages 1 are guided over an initial guide ring 5, which is positioned concentricly about the central axis of the spindle 8. The ring 5 is connected to the hub 12 of the carrier 3 by means of a rod 18. The central spindle also includes a coaxial yarn duct 19 having an inlet end and a radial yarn outlet opening 20. The yarns from the packages 1 are thus combined to form a composite yarn at the yarn inlet end of the duct 19, and as the composite yarn exits from the radial bore 20 an initial twist is imparted. The yarn then advances along a radial guide arm 56 which serves to balloon the advancing yarn about the central axis upon rotation of the spindle, as indicated at 16, and so as to impart a second or double twist to the advancing yarn. The yarn then passes through the fixed balloon yarn guide 10. In the illustrated embodiment, the twisted yarn 11 is deflected on the balloon yarn guide 10 and advances via the yarn guides 17, 21 to the yarn advancing system, which comprises a rear spindle extension 31 and a pressure roll 35 which is resiliently biased against the spindle extension 31 by conventional means (not shown). The pressure roll is rotatably supported in a fork 34 which is pivotally mounted on the portion 33 of the frame. From the advancing device 31, 35, the yarn is guided to a yarn accumulation means 39, which comprises, in the illustrated embodiment, a stationary yarn guide rod 22 and a yarn guide rod 23 which is pivotally mounted for movement about a pivot 25. A spring 26 is provided for biasing the rod 23 toward the left and away from the rod 22 as seen in FIG. 1.

The central spindle 8 is driven by a motor 27, with the motor 27 acting through a first belt pulley 28 mounted on the motor shaft and a second belt pulley 29 mounted on the spindle 8. A belt 30 interconnects the pulleys 28 and 29. A micro switch 38 is mounted adjacent the rod 23, and the switch includes a contact 37 which cooperates with a contact plate 36 on the rod. In the outer position of the yarn guide rod 23, there is no contact between the contact 37 and the plate 36, and thus the motor is disconnected. As soon as the supply of yarn on the accumulator 39 is below a predetermined minimum amount, the rod 23 will be pivoted against the force of the spring 26 and toward the rod 22, and the micro switch 38 will be actuated by contact with the plate 36, thereby energizing the drive motor. The spindle 8, and also the advancing system comprising the spindle extension 31 and the pressure roll 35, will operate to advance the yarn 11 into the accumulator 39. As the supply increases, the rod 23 will move to the left by the action of the spring 26, and away from the rod 22, until the contact 37 is released when the intended amount of yarn is again present on the accumulator. The drive motor is then disconnected.

In the illustrated embodiment of FIG. 1, a sleeve 32 is coaxially mounted on the rear spindle extension 31, and so as to preclude relative rotation therebetween. Thus the sleeve 32 and pressure roll 35 form the actual advancing system. The selective use of the spindle extension 31 itself as the operative conveying surface, or one of a number of sleeves 32 having different diameters, permits the twist ratio to be varied in a relatively wide range. As illustrated, the sleeve 32 includes an end which engages a shoulder 40 on the spindle, and to preclude relative rotation, the end of the sleeve 32 and the shoulder 40 may be provided with mating notches.

Figure 2:
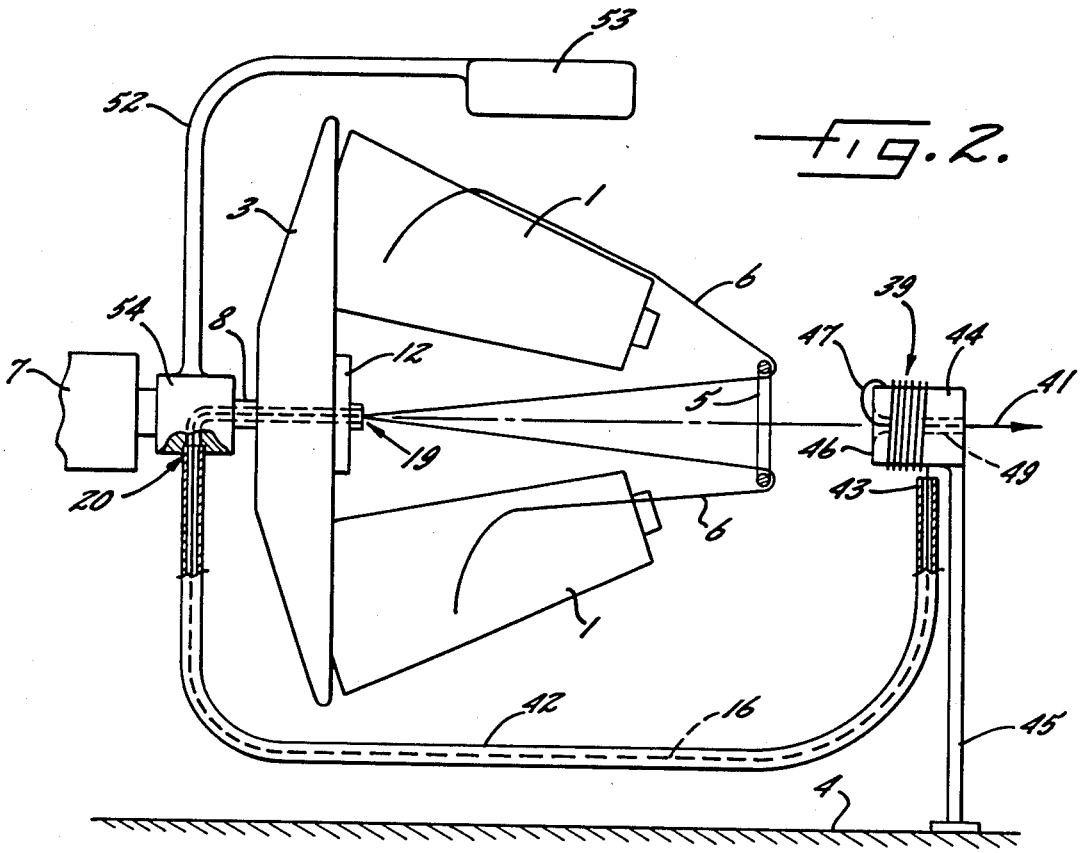
FIG. 2 is a fragmentary side elevation view of a second embodiment of the invention.
Figure 3:
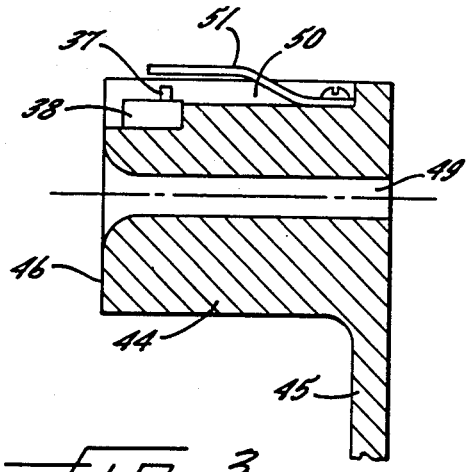
FIG. 3 is a sectional view of a body of rotation and sensor means, in accordance with one embodiment of the invention.
Figure 4:
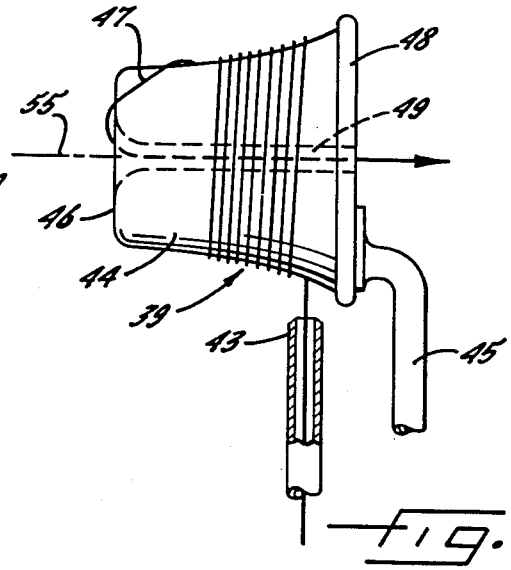
FIG. 4 is a fragmentary view of another embodiment of a body of rotation adapted for use with the present invention.

FIG. 2 illustrates a modified embodiment of the present invention, and wherein the yarn exiting from the outlet opening 20 of the spindle 8 is directed into a tube 42, which is fixed to the spindle 8. To counterbalance the weight of the tube 42, the opposite side of the spindle mounts a weight 53 at the end of an arm 52. The tube 42 delivers the yarn through its outlet 43, which is in the area of the tip of the yarn balloon 16, to a stationary body of rotation 44. The body of rotation 44 may take the form of a cylinder as seen in FIG. 3, or it may have a hyperbolic outline as seen in FIG. 4. In either case, the body of rotation is connected to the machine frame 4 by the post 45. Also, the body defines an end 46 which faces the spindle 8, and a central bore 49 which is coaxial with the central axis of the spindle 8. The yarn is looped onto the body of rotation at the rear end of the body, and the yarn is inserted as a loop 47 at the end 46 into the central bore 49, and the yarn is withdrawn as a finished yarn at the other end of the bore 49 in the direction 41, note FIGS. 2 and 4.

In the embodiment of FIG. 2, the yarn advancing mechanism differs substantially from that of the embodiment of FIG. 1. Specifically, the body of rotation 44 serves not only as the yarn accumulator 39, but also as part of the yarn advancing system which comprises the body of rotation 44 and the tube 42 and its outlet opening 43, which is fixed to the spindle 8 and rotates with the same.

The ratio of yarn speed to spindle speed may be changed by replacing the body of rotation 44 with one having a different outside diameter. In so doing, it is desirable to keep the distance between the outlet opening 43 and the surface of the body of rotation 44 as small as possible, particularly when the body has a noncylindrical configuration as shown in FIG. 4, so as to insure proper placement of the yarn on the body and the desired advance speed of the yarn.

The design of the sensor means for monitoring the amount of yarn received on the yarn accumulation means is different in FIGS. 2–4 from that shown in FIG. 1. Specifically, a start-stop switch 38 is used, which is interposed in the circuit of the motor. As seen in FIG. 3, the surface of the body of rotation 44 is provided with an axially directed slot 50, which accommodates a spring contact arm 51, as well as the micro switch 38 having a contact button 37. When there is no yarn winding on the body of rotation, the arm 51 projects outwardly from the slot as shown in FIG. 3. As the winding progresses from the right, and at the yarn tension which is present in the balloon 16, the contact arm 51 is pushed further and further into the slot 50, and until it finally actuates the contact button 37 of the switch 38 and stops the motor 27. As the yarn supply on the body 44 is used, the contact arm is again released, which leads to the restarting of the drive motor 27.

Figure 5:
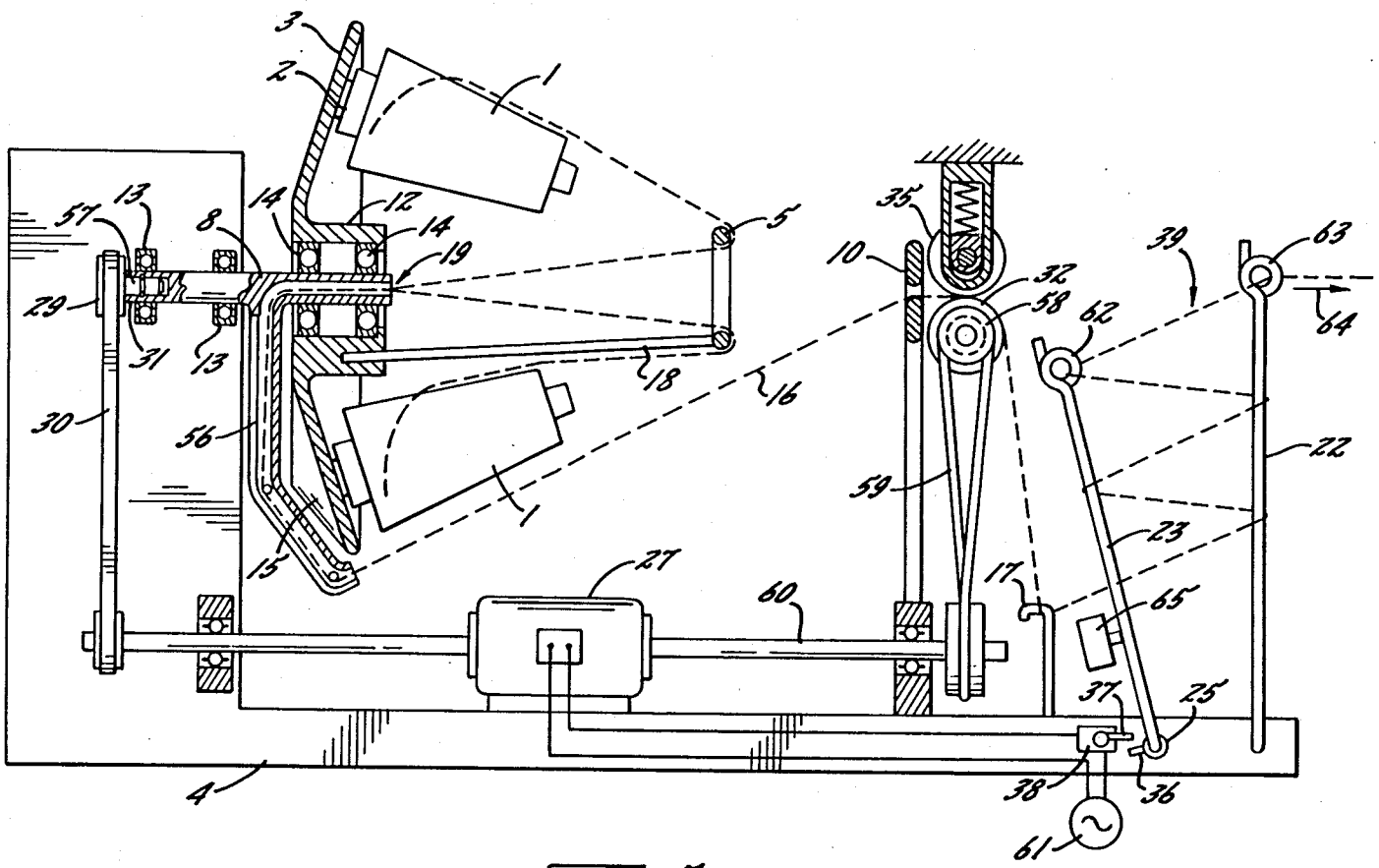
FIG. 5 is a view similar to FIG. 1 and illustrating still another embodiment of the invention.

In the embodiment of FIG. 5, the stand 4 accommodates a double twist spindle 8 which is supported by the bearings 13 along a substantially horizontal central axis. The package carrier 3 is floatingly supported on the spindle 8 by the bearings 14, and the carrier is held in a substantially fixed position by a weight 15 which is offset from the axis. A plurality of package supports 2 are mounted on the carrier 3, and the supply packages 1 are mounted on the supports, with the packages containing yarns which may be of different colors. FIG. 5 shows two of such supply yarn packages 1.

Attached to the hub 12 of the package carrier 3 is a rod 18, which mounts on its outer end a yarn guide 5 which is in the form of a ring which is concentric to the central axis. The spindle 8 has a bore 19 which extends through the bearing 14, and bends into a radial direction and terminates in a radial balloon control guide 56. The balloon control guide 56 extends substantially in a radial direction and is designed as a slotted tube. A balloon yarn guide 10 is mounted on the right side of the spindle and along the central axis as seen in FIG. 5, and a yarn advancing system in the form of a rotatably driven roll 32 is positioned on the downstream side of the guide 10. A spring presses the pressure roll 35 against the roll 32 of the advancing system. A belt pulley 58 is coaxially and fixedly mounted with respect to the roll 32, and a yarn guide 17, which is fixed to the base 4, serves for guiding the yarn toward the yarn accumulator 39. The yarn accumulator 39 comprises two rods 22 and 23 disposed side by side in a common plane, and which are adapted to perform relative movement toward and away from each other for the purposes of changing the separation distance therebetween. To this end, the rod 23 is designed as a lever which adapted to pivot about a pivot 25, and the other rod 22 is rigidly supported. The pivot end of the rod 23 mounts a cam 36 which cooperates with the contact button 37 of the stationary switch 38.

The spindle end 31 includes a central bore, which permits the selective mounting of belt pulleys 29 of different diameters. For this purpose, the belt pulleys are provided with a journal 57, which fits into the bore of the spindle end 31, so that it can be axially retained and locked against relative rotation.

The motor 27 and the shaft 60 drive the spindle 8 via the belt 30 and pulley 29, and they also drive the yarn advancing roll 32 via the belt 59 and the pulley 58. In so doing, the twist ratio may be determined by selecting the belt pulley 29 of an appropriate diameter.

In operation, several yarn supply packages 1 are mounted on the supports 2 of the carrier 3. The yarns are then guided along a folded yarn path through the guide 5, then into the inlet end of the duct 19 of the spindle. The yarn continues through the duct and then advances radially outwardly through the balloon yarn guide 56. From the guide 56, the yarn is returned to the central axis of the spindle at the balloon yarn guide 10, and then passed through the advancing system at the roll 32. The yarn is then guided via the stationary guide 17 into the area of the rods 22, 23, and is looped several times, for example twice, about the rods 22 and 23. The yarn leaves the yarn accumulator through the eyelets 62, 63 on the ends of the rods 23 and 22 respectively. The yarn is then fed, for example, to a hand knitting machine or to a hand operated ball winder (not shown). When the hand knitting machine or ball winder is put into operation, or when the knitter needs yarn for hand knitting, and the yarn is withdrawn in the direction of arrow 64, the length of the yarn wound upon the rods 22 and 23 is reduced. As a result, the rod 23 is pivoted until the cam 36 contacts the button 37 of the switch 38. The drive motor 27 is then started, and the spindle 8 and the advancing system composed of the roll 32 are synchronously put into operation. The advancing system causes the yarn to be unwound from the supply packages 1, and as a result of the rotation of the spindle 8 along with the balloon yarn guide 56, the yarn forms a balloon 16 between the exit end of the guide 56 and the balloon yarn guide 10. The yarn is twisted and simultaneously advanced to the yarn accumulator 39, and the pivotal rod 23, which is loaded by a weight 65 as seen in FIG. 5, is moved so that the distance between the stationary rod and the pivotal rod increases. Thus, an increased quantity of yarn is stored in the accumulator 39, and the accumulating yarn is made available for immediate use in the direction of arrow 64. The accumulator 39 thus functions as a material buffer, and at the same time, the accumulator functions as a device for measuring the use and the supply of the yarn and thus is a regulating element in a two point control loop in which the supply of twisted yarn is adapted to the use thereof. Fluctuations in the processing speed are compensated by the movement of the pivotal rod 23. Upon termination of the use, the twisting and advancing operations are interrupted when the accumulator receives an amount of yarn which is predetermined by the positioning of the switch 38. The color composition of the composite finished yarn can be changed at any time by exchanging one or several of the supply packages 1.

In the drawings and specification, there has been set forth a preferred embodiment of the invention, and although specific terms are employed, they are used in a generic and descriptive sense only and not for purposes of limitation.

I claim:

1. A yarn twisting apparatus comprising a central spindle mounted for rotation about a central axis, a yarn guide mounted at a location which is in general alignment with said central axis, a yarn package carrier mounted adjacent said spindle, yarn accumulation means, drive means for rotating said spindle about said central axis, and for advancing a yarn from a package mounted on said package carrier to said yarn guide and then to said yarn accumulation means at a speed coordinated with the rotational speed of said spindle, and while ballooning the yarn about said central axis as it advances between the package and said yarn guide, and sensor means for monitoring the amount of yarn received on said yarn accummulation means and for operating said drive means so as to rotate said spindle and deliver twisted yarn to said accumulation means whenever the amount of yarn on said accumulation means is below a predetermined minimum amount, whereby a yarn may be withdrawn from a yarn package mounted on said carrier and ballooned about said central axis to impart twist thereto, and with the twisted yarn being accumulated on said accumulation means, and such that the twisted yarn may be intermittently withdrawn from said accumulation means by a user and said predetermined minimum amount of the twisted yarn will be automatically maintained on said accumulation means.

2. A yarn twisting apparatus comprising a central spindle mounted for rotation about a central axis and having a coaxial yarn duct therein and which includes a yarn inlet end and a yarn outlet opening, a yarn package carrier mounted adjacent said spindle, yarn guide means including a guide arm fixedly mounted to said spindle, for ballooning an advancing yarn about said central axis after exiting from said outlet opening and upon rotation of said spindle, and so as to impart twist to the advancing yarn, yarn accumulation means, drive means for rotating said spindle about said central axis, and for advancing a yarn from said yarn guide means to said yarn accumulation means at a speed coordinated with the rotational speed of said spindle, and sensor means for monitoring the amount of yarn received on said yarn accummulation means and for operating said drive means so as to rotate said spindle and deliver twisted yarn to said accumulation means whenever the amount of yarn on said accumulation means is below a predetermined minimum amount, whereby a yarn may be withdrawn from a yarn package mounted on said carrier and advanced into said inlet opening and through said duct to said outlet opening, then ballooned about said central axis to impart twist thereto, and with the twisted yarn being accumulated on said accumulation means, and such that the twisted yarn may be intermittently withdrawn from said accumulation means by a user and said predetermined minimum amount of the twisted yarn will be automatically maintained on said accumulation means.

3. The yarn twisting apparatus as defined in claim 1 or 2 wherein said drive means includes cylindrical surface means mounted coaxially on said spindle for rotation therewith.

4. The yarn twisting apparatus as defined in claim 3 wherein said drive means further includes a pressure roller mounted so as to form a nip between said pressure roller and said cylindrical surface means, and such that the yarn is adapted to be advanced through said nip upon rotation of said spindle.

5. The yarn twisting apparatus as defined in claim 4 wherein said cylindrical surface means includes a sleeve of a predetermined outer diameter releaseably mounted upon said spindle and for rotation therewith, and such that sleeves having different outer diameters may be selectively mounted on said spindle so as to change the ratio of the yarn advance speed to the imparted twist.

6. The yarn twisting apparatus as defined in claim 1 or 2 wherein said yarn accumulation means comprises a pair of rods adapted for supporting a yarn looped thereabout, means mounting said rods for movement toward and away from each other to thereby vary the quantity of the yarn looped thereabout, means for biasing the rods away from each other and such that a withdrawal of the yarn by a user acts to move said rods toward each other and against the force of said biasing means, and switch means for operating said drive means whenever said rods are less than a predetermined separation and so as to advance more twisted yarn to said accumulation means.

7. The yarn twisting apparatus as defined in claim 6 wherein one of said pair of rods is fixedly mounted, and the other of said rods is pivotally mounted at one end thereof.

8. The yarn twisting apparatus as defined in claim 2 wherein said drive means includes a body of rotation fixedly mounted at an operative position which is coaxial with said central axis, said body of rotation including an outer surface which is adapted to have the advancing yarn wound thereupon by said yarn guide means and such that said outer surface serves as said yarn accumulation means.

9. The yarn twisting apparatus as defined in claim 8 wherein said body of rotation includes a coaxial bore therethrough, and such that the yarn which is wound upon said outer surface is adapted to be withdrawn through said coaxial bore.

10. The yarn twisting apparatus as defined in claim 9 wherein said sensor means is mounted on said body of rotation, and includes a resilient arm mounted to extend along a direction parallel to said central axis, said arm having one end fixed to said body of rotation and an opposite free end, and a switch mounted adjacent said free end of said arm and such that the yarn wound upon said body of rotation acts to press said arm against said switch to disconnect said drive means upon said predetermined amount of the yarn being wound upon said body of rotation.

11. The yarn twisting apparatus as defined in claim 8 wherein said outer surface of said body of rotation is cylindrical.

12. The yarn twisting apparatus as defined in claim 8 wherein said body of rotation is of generally hyperbolic configuration, with the more narrow end thereof being disposed toward said spindle, and with said guide means being positioned so as to wind the yarn on said body of rotation adjacent the larger end thereof.

13. The yarn twisting apparatus as defined in claim 8 further comprising means for releaseably mounting said body of rotation at said operative position, and such that bodies of rotation having different diameters may be selectively mounted at said operative position so as to change the ratio of yarn advance speed to the imparted twist.

14. A yarn twisting apparatus comprising a central hollow spindle mounted for rotation about a central axis and having a coaxial yarn duct therein and which includes a yarn inlet end and a yarn outlet opening therein, a yarn package carrier mounted coaxially about said spindle and so as to preclude the free rotation of said carrier about said central axis, and such that said inlet end is on one side of said carrier and said outlet opening is on the other side of said carrier, initial yarn guide means mounted on said package carrier for guiding a yarn withdrawn from a package mounted on said carrier into said inlet end of said spindle, ballooning yarn guide means including a radial guide arm fixedly mounted to said spindle, for ballooning an advancing yarn about said central axis after exiting from said outlet opening and upon rotation of said spindle, and so as to impart twist to the advancing yarn, yarn accumulation means, drive means for rotating said spindle about said central axis, and for advancing a yarn from said ballooning yarn guide means to said yarn accumulation means at a speed coordinated with the rotational speed of said spindle, and sensor means for monitoring the amount of yarn received on said yarn accummulation means and for operating said drive means so as to rotate said spindle and deliver twisted yarn to said accumulation means whenever the amount of yarn on said accumulation means is below a predetermined minimum amount, whereby a yarn may be withdrawn from a yarn package mounted on said carrier and advanced into said inlet end and through said duct to said outlet opening, then ballooned about said central axis to impart twist thereto, and with the twisted yarn being accumulated on said accumulation means, and such that the twisted yarn may be intermittently withdrawn from said accumulation means by a user and said predetermined minimum amount of the twisted yarn will be automatically maintained on said accumulation means.

15. The yarn twisting apparatus as defined in claim 14 wherein said yarn package carrier is mounted for rotation about said central axis, and includes weight means for precluding the free rotation thereof about said central axis.

16. The yarn twisting apparatus as defined in claim 15 wherein said ballooning yarn guide means further includes a fixed yarn guide positioned coaxially along said central axis and on said one side of said carrier.

17. The yarn twisting apparatus as defined in claim 16 wherein said central axis is substantially horizontal.

* * * * *